US011355828B2

(12) United States Patent
Alton

(10) Patent No.: US 11,355,828 B2
(45) Date of Patent: Jun. 7, 2022

(54) DEFECTED GROUND STRUCTURE COPLANAR WITH RADIO FREQUENCY COMPONENT

(71) Applicant: Knowles Cazenovia, Inc., Cazenovia, NY (US)

(72) Inventor: Gregory Alton, Cazenovia, NY (US)

(73) Assignee: Knowles Cazenovia, Inc., Cazenovia, NY (US)

( * ) Notice: Subject to any disclaimer, the term of this patent is extended or adjusted under 35 U.S.C. 154(b) by 0 days.

(21) Appl. No.: 16/864,088

(22) Filed: Apr. 30, 2020

(65) Prior Publication Data

US 2020/0358160 A1 Nov. 12, 2020

Related U.S. Application Data

(60) Provisional application No. 62/844,074, filed on May 6, 2019.

(51) Int. Cl.
*H01P 3/00* (2006.01)

(52) U.S. Cl.
CPC ..... *H01P 3/003* (2013.01)

(58) Field of Classification Search
CPC ..... H01P 3/003
See application file for complete search history.

(56) References Cited

U.S. PATENT DOCUMENTS 5,869,429 A * 2/1999 Das ..... H01P 1/2013 505/210
7,151,423 B2 * 12/2006 Sangawa ..... H01P 1/2013 333/134
7,420,442 B1 * 9/2008 Forman ..... H01P 1/12 333/205
7,449,980 B2 11/2008 Bates
7,663,454 B2 2/2010 Bates
(Continued)

FOREIGN PATENT DOCUMENTS

CN 202121040 U 1/2012
WO 2018182584 A1 10/2018

OTHER PUBLICATIONS

Nadeau, U.S. Appl. No. 16/699,187, U.S. Patent and Trademark Office, filed Nov. 29, 2019.
(Continued)

*Primary Examiner* — Samuel S Outten
(74) *Attorney, Agent, or Firm* — Loppnow & Chapa; Matthew C. Loppnow; Roland K. Bowler, II

(57) ABSTRACT

A microwave or radio frequency (RF) device includes a substrate including an electrically insulating material. The substrate has a first surface and a second surface parallel to the first surface. The device further includes a RF component disposed over the first surface of the substrate. The device also includes a conductive layer disposed over the second surface of the substrate, the conductive layer forming a ground plane electrically insulated from the RF component. The device further includes a defected ground structure disposed on a surface of the substrate that is coplanar with the first surface, where the defected ground structure is electrically connected to the conductive layer, and where the defected ground structure includes a plurality of laterally extending members adjacent to the RF component and extending laterally in relation to the RF component.

19 Claims, 15 Drawing Sheets

(56) References Cited

U.S. PATENT DOCUMENTS

| | | | | |
|---|---|---|---|---|
| 7,956,708 | B2 | 6/2011 | Bates | |
| 9,490,768 | B2 | 11/2016 | Randall | |
| 10,547,096 | B2 | 1/2020 | Bates | |
| 10,770,776 | B2 | 9/2020 | Bates | |
| 2014/0139300 | A1* | 5/2014 | Brown | H05K 1/0216 333/246 |
| 2020/0021030 | A1 | 1/2020 | Bates | |
| 2020/0259263 | A1 | 8/2020 | Dani | |
| 2020/0403286 | A1 | 12/2020 | Burdick | |

OTHER PUBLICATIONS

Burdick, U.S. Appl. No. 17/013,504, U.S. Patent and Trademark Office, filed Sep. 9, 2020.

Chen, Leakage-Reduced Conductor-Backed Coplanar Waveguide With Periodic Structures and its Antenna Application, IEEE Transactions on Antennas and Propagation, vol. 59, No. 6, Jun. 30, 2011.

Ma, Experimentally Investigating Slow-Wave Transmission Lines and Filters Based on Conductor-Backed CPW Periodic Cells, IEEE, Oct. 31, 2005.

Zhao, Search Report, Application No. 202010371471.9, China National Intellectual Property Administration, dated 2021.

* cited by examiner

DEFECTED GROUND STRUCTURE COPLANAR WITH RADIO FREQUENCY COMPONENT

BACKGROUND

Microwave and radio-frequency (RF) circuits can include components such as filters that can filter an input signal to generate a filtered output signals. The filters can include, for example, band-pass filters, high-pass filters, low-pass filters etc.

SUMMARY

In an embodiment, a RF device includes a substrate having a first surface and a second surface parallel to the first surface, the substrate including an electrically insulating material. The device further includes a RF component disposed over the first surface of the substrate. The device also includes a conductive layer disposed over the second surface of the substrate, the conductive layer forming a ground plane electrically insulated from the RF component. The device further includes a defected ground structure disposed on a surface of the substrate that is coplanar with the first surface, where the defected ground structure is electrically connected to the conductive layer, and where the defected ground structure includes a plurality of laterally extending members adjacent to the RF component and extending laterally in relation to the RF component.

In some embodiments, two adjacent members of the plurality of laterally extending members define a gap having a dimension in a direction that is parallel to a longitudinal axis of the RF component. In some embodiments, the plurality of laterally extending members includes at first laterally extending member that is disposed on a first side of the RF component, and a second laterally extending member that is disposed on a second side, opposite to the first side, of the RF component. In some embodiments, each of the plurality of laterally extending members has a longitudinal axis that is perpendicular to a longitudinal axis of the RF component. In some embodiments, each of the plurality of laterally extending members has a longitudinal axis that is not perpendicular to a longitudinal axis of the RF component.

In some embodiments, a shape of the defected ground structure is symmetric about a longitudinal axis of the RF component. In some embodiments, the plurality of laterally extending members are unevenly spaced. In some embodiments, at least one of the plurality of laterally extending members has a non-linear shape. In some embodiments, at least one of the plurality of laterally extending members has a fan shape. In some embodiments, at least one of the plurality of laterally extending members has a T shape. In some embodiments, the defected ground structure defines at least one loop formed by connecting at least two of the plurality of laterally extending members (e.g., with or using at least one conductive area, and/or at least one interconnecting member), the at least one loop extending around an exposed area of the first surface of the substrate. In some embodiments, the plurality of laterally extending members have non-uniform width measured in a direction that is parallel to a direction of a longitudinal axis of the RF component.

In some embodiments, the RF component includes an input terminal and an output terminal, wherein the plurality of laterally extending members are positioned adjacent a portion of the RF component between the input terminal and the output terminal. In some embodiments, a length of the plurality of laterally extending members measured in a dimension normal to a longitudinal axis of, and coplanar with, the RF component, is a function of a resonant frequency of the defected ground structure.

In some embodiments, the resonant frequency of the defected ground structure is greater than a cut-off frequency of the RF component, wherein the RF component is a low-pass filter. In some embodiments, the device further includes a band-pass filter disposed over the first surface of the substrate and coupled with the RF component, wherein the resonant frequency of the defected ground structure is greater than a highest pass-band frequency of the band-pass filter.

In some embodiments, the resonant frequency of the defected ground structure has a value in a range of 1 GHz to 300 GHz. In some embodiments, the device further includes a conductive cover disposed over the first surface of the substrate, the conductive cover electrically coupled with the defected ground structure, wherein the conductive cover covers the RF component. In some embodiments, the defected ground structure includes a conductive region extending in a direction parallel to a longitudinal axis of the RF component, wherein the conductive region is electrically coupled with a conductive cover that covers the RF component. In some embodiments, the defected ground structure includes vias for attaching a conductive cover that covers the RF component, the vias providing an electrical connection between the defected ground structure, the conductive cover, and the conductive layer.

The foregoing summary is illustrative only and is not intended to be in any way limiting. In addition to the illustrative aspects, embodiments, and features described above, further aspects, embodiments, and features will become apparent by reference to the following drawings and the detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

Figure 1:
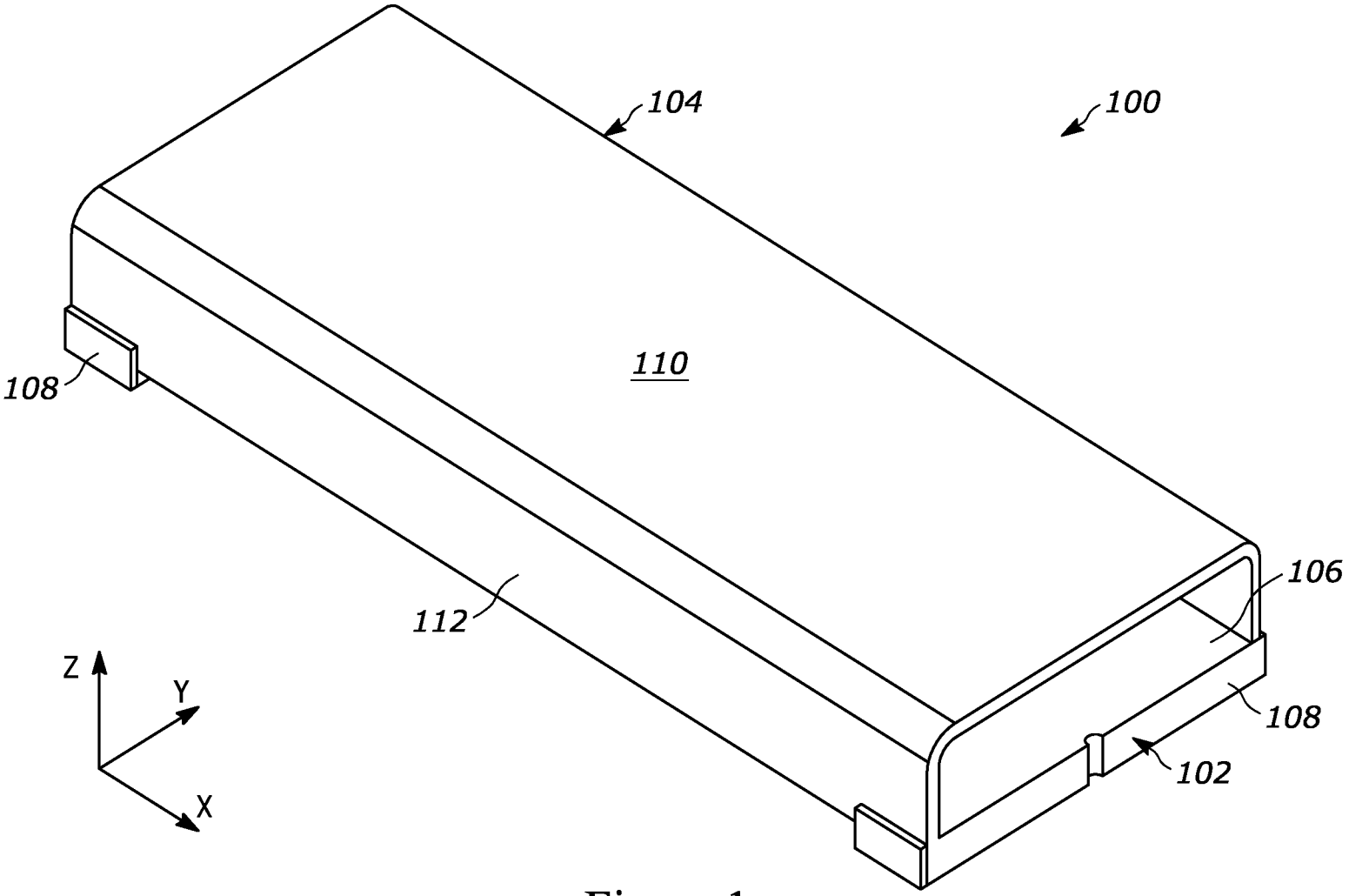
FIG. 1 shows an isometric view of an example RF device according to embodiments of the present disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

DETAILED DESCRIPTION

The present disclosure describes devices and techniques for signal processing using microwave or RF devices (collectively referred to herein as "RF devices"). The RF devices can include a substrate having at least one ground plane and a signal terminal. One or more RF circuits can be formed on the substrate, where the RF circuits can include components such as filters, amplifiers, resonators, phase shifters, etc.

In some instances, the RF devices can include filters such as a band-pass filter, which can include, provide and/or define a pass-band in the frequency spectrum. The band-pass filter can attenuate frequency components of an input signal that lie outside of the pass-band. However, the frequency response of the band-pass filter can have repeated pass-bands at frequencies higher than the desired pass-band. Such high frequency pass-bands can be referred to as harmonics, and can undesirably introduce high frequency components of the input signal into the output signal. One approach to mitigating or suppressing the effect of harmonics in the pass-band frequency response is to cascade a low-pass filter with the band-pass filter (e.g., to form a combined band-pass and low-pass filter), where the cut-off frequency of the low-pass filter can be positioned below the frequency of the harmonics. However, the suppression by the low-pass filter is often inadequate. One approach to improving the suppression offered by the low-pass filter is to make the frequency roll-off of the low pass filter steeper. This can be achieved, for example, by adding additional resonators, or using a slow wave structure. However, these approaches can result in an increase in the size of the filter (and in turn the RF device), which is undesirable.

One solution, discussed in relation to the embodiments disclosed herein, to improving the suppression of harmonics is to utilize a defected ground structure (DGS) that is coplanar with an RF component, such as, for example, a filter. The DGS is positioned in the same plane as the RF component, and can include a plurality of laterally extending members that are positioned adjacent to the RF component. The DGS can be electrically connected to a ground plane positioned on a separate surface of a substrate on which the RF component and the DGS are disposed. The DGS can form a ground that has resonant characteristics. The resonant frequency of the DGS can be selected such that the undesirable harmonics are suppressed. The DGS (coplanar with the RF component) can be different from embodiments where a DGS is formed within a ground plane that is positioned on a separate surface of the substrate that does not include the RF component. Such a ground plane is typically a solid sheet of metal (with vias), and a DGS in the ground plane can be a negative space (or voids) in the metal sheet, which produces an effect on the signal of the RF component. In contrast, the coplanar DGS discussed in the embodiments herein is a positive space (e.g., conductive material extended from or added) to a ground structure that is brought to (or extended to) the same layer as the signal path, making the DGS coplanar with the RF component. The coplanar DGS also affects the signal in the RF component. However, the effect is not produced by voids, but produced by laterally extending resonant structures of conductive material on the same layer as the RF component.

In some embodiments, a set of vias can connect the DGS to the ground plane through the substrate. The laterally extending members extend laterally from the set of vias (e.g., towards the RF component and electrically insulated from the RF component) but are physically isolated from the RF component. An effective length of each laterally extending member can be a function of a frequency. For example, the effective length can be a quarter wavelength or half wavelength of the frequency of the harmonics that are to be suppressed. The effect on the signal created by the laterally extending member can be a function of frequency. In some embodiments, the effective length of the laterally extending member can be expressed in terms of electrical length, such as the that mentioned above, in the form of a function of the wavelength. In some embodiments, the effective length can be expressed in the form of distance units, such as mils (thousands of an inch), microns, etc. In some embodiments, the effective length can be a function of the frequency of the harmonics that are to be suppressed and the materials used to form the substrate and the RF component.

In some embodiments, DGS can include the laterally extending members that are positioned on one side or each side of the RF component. In some embodiments, the DGS can include laterally extending members of various shapes, such as rectangular, T-shaped, looped, fan-shaped. In some embodiments, the DGS can include laterally extending members that have non-uniform dimensions or spacing. The shape and sizes of the laterally extending members can be selected based on the desired resonant frequency response.

FIG. 1 shows an isometric view of an example RF device 100. The RF device 100 includes a substrate 102 and a cover 104 disposed on the substrate 102. The substrate 102 can include a first surface 106 and an opposite second surface (not shown) that faces in a direction opposite to the direction in which the first surface 106 faces. In some embodiments, the second surface can be in a plane that is parallel to a plane of the first surface 106. The substrate 102 also includes side surfaces 108 that extend between the first surface 106 and the opposite second surface. One or more RF components can be formed over the first surface 106 of the substrate 102. A ground plane can be formed on the second surface of the substrate 102, which is for instance not coplanar with the one or more RF components. The ground plane can be a metal or a conductive layer that covers the second surface of the substrate 102 (shown in FIGS. 12-14). The substrate 102 can be formed using non-conductive materials such as, for example, ceramics (e.g., alumina, aluminum nitride, and beryllium oxide), plastic, glass, semiconductors (e.g., gallium arsenide (GaAs), indium phosphate (InP), and silicon), and other non-conductive materials.

The cover 104 is disposed on and affixed to the substrate 102. The cover 104 is conductive, and can be formed using materials such as, for example, copper, aluminum, silver, gold, etc. At least a portion of the cover 104 can also cover one or more side surfaces 108 of the substrate 102. For example, the cover 104 can include a cover plate 110 and two side cover plates 112. The two side cover plates 112 are coupled to two opposite sides of the cover plate 110 of the cover 104. Two side surfaces 108 of the substrate 102 can include a conductive coating with which the two side cover plates 112 can make contact. The conductive coating on the two side surfaces 108 of the substrate 102 can be electrically connected to the ground plane on the second surface of the substrate 102. By having the two side cover plates 112 be in contact with the conductive coating on the side surfaces 108, the cover 104 is electrically connected to ground. Portions of the two side cover plates 112 can be attached to the conductive coating on the side surfaces 108 by way of screws, adhesive, epoxy, solder and the like. In some instances, the first surface 106 can include vias with which at least portions of the two side cover plates 112 can be coupled. For example, one or more vias can be positioned along the peripheries of first surface 106 of the substrate 102. The vias can include a conductive coating which is electrically connected to the ground plane positioned on the second surface of the substrate 102. The vias can include openings or slots (with conductive coatings) in which portions of the two side cover plates 112 can be inserted. At least a portion of each of the two side cover plates 112 can be positioned over or inserted into the vias on the substrate 102. The two side cover plates 112 can be attached to the vias by way of screws, adhesive, epoxy, solder and the like.

Figure 2:
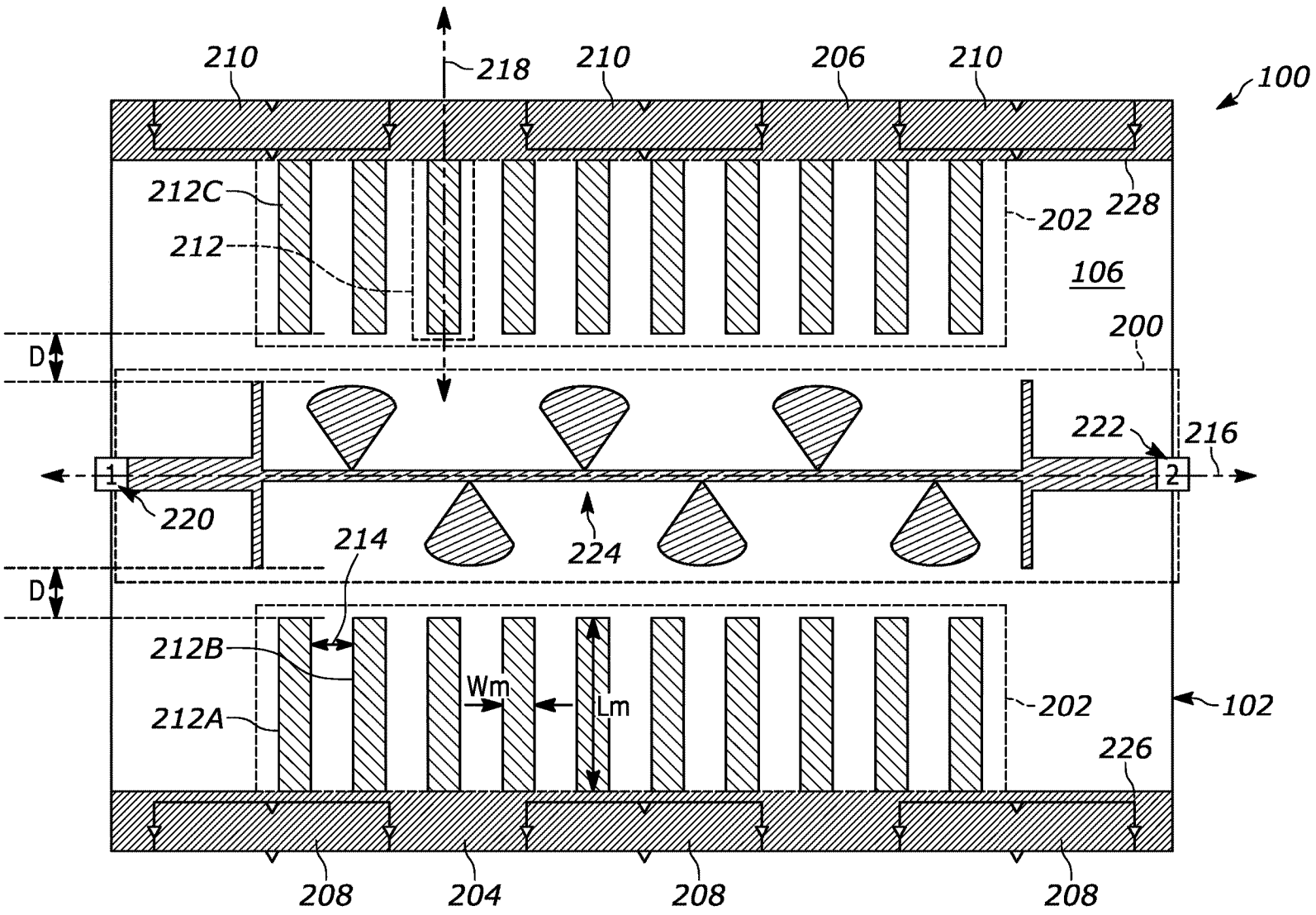
FIG. 2 shows a top view of a substrate of an RF device including a first example coplanar defected ground structure (DGS).

One or more RF components can be disposed on or within the substrate 102. For example, one or more RF components can be formed on the first surface 106 of the substrate 102. FIG. 2 shows one example RF component 200 disposed on the first surface 106 of the substrate 102 of the RF device 100 shown in FIG. 1. The RF component 200 shown is a low-pass filter, however any other RF component, such as a high-pass filer, a band-pass filter, an amplifier, a transmission line, etc. can be included. A DGS 202 is formed on the first surface 106 of the substrate 102. The DGS 202 is coplanar with the RF component 200. That is, the surface on which the DGS 202 is formed is coplanar with the surface on which the RF component 200 is formed. In some embodiments, the RF component 200 can be a distributed elements RF component. Distributed elements RF components can utilize pattered geometries of metal to produce a desired effect on an input signal provided to the RF components. This is in contrast to lumped elements RF components, which utilize discrete components, such as capacitors and inductors. In some embodiments, the RF device 100 can include a combination of distributed elements RF components and lumped elements RF components.

A first conductive area 204 and a second conductive area 206 are formed on the first surface 106 of the substrate 102. The first conductive area 204 and the second conductive area 206 are electrically coupled to a ground plane formed on the second surface of the substrate 102. In the embodiment shown in FIG. 2, the first conductive area 204 and the second conductive area 206 are connected to the ground plane by vias. Alternatively, the first conductive area 204 and the second conductive area 206 can be connected to the ground plane on the second surface of the substrate 102 by conductive coating on the side surfaces 108 of the substrate that make contact with the first and the second conductive areas 204 and 206 on the first surface and also make contact with the ground plane on the second surface of the substrate 102. As shown in FIG. 2, the first conductive area includes a first set of vias 208 and the second conductive area includes a second set of vias 210. The first set of vias 208 form a conductive path between the first conductive area 204 and the ground plane, while the second set of vias 210 form a conductive path between the second conductive area 206 and the ground plane on the second surface of the substrate 102.

The two side cover plates 112 of the cover 104 can be attached to or make contact with the first conductive area 204 and the second conductive area 206. In some embodiments, the two side cover plates 112 can include protrusions that can be inserted into the first set of vias 208 and the second set of vias 210. In this manner, the cover 104 is electrically connected to the ground plane on the second surface of the substrate 102.

The DGS 202 is also electrically connected to the ground plane on the second surface of the substrate 102 through the vias or the conductive coatings on the side surfaces 108 of the substrate 102. The DGS 202 includes a plurality of laterally extending members 212 that extend laterally in relation to the RF component 200. In particular, the laterally extending members 212 can be positioned such that two adjacent laterally extending members are separated by a gap. For example, two adjacent laterally extending members 212A and 212B are separated by a gap 214 that has a dimension in a direction that is parallel to a longitudinal axis 216 of the RF component 200.

The DGS 202 can include laterally extending members 212 that are disposed on either side of the RF component 200. For example, the DGS 202 can include a first laterally extending member 212A that is positioned on one side of the RF component 200 and a second laterally extending member 212C that is positioned on the opposite side of the RF component 200. Specifically, the first laterally extending member 212A is positioned on the side of the RF component 200 on which the first set of vias 208 are positioned and the second laterally extending member 212C is positioned on the side of the RF component 200 on which the second set of vias 210 are positioned. In some instances, being positioned on either side of the RF component 200 can refer to being positioned on either side of the longitudinal axis 216 of the RF component 200. The DGS 202 can include a plurality of laterally extending members 212 on either side of the RF component 200. FIG. 2 shows the DGS 202 including ten laterally extending members 212 on either side of the RF component 200. However, the number of laterally extending members 212 on either side of the RF component 200 can be different from that shown in FIG. 2. As an example, the DGS 202 can include at least two laterally extending members 212 on either side of the RF component 200, where any two adjacent laterally extending members 212 on one side of the RF component 200 are separated by a gap, such as, for example, the gap 214, which has a dimension in a direction that is parallel to the longitudinal axis 216 of the RF component 200.

Each of the plurality of laterally extending members 212 has a longitudinal axis 218 that is perpendicular to the longitudinal axis 216 of the RF component 200. In some instances, a subset of the laterally extending members 212 can have their respective longitudinal axes that are not perpendicular to the longitudinal axis 216 of the RF component 200. At least one example of laterally extending members 212 having longitudinal axes that are not perpendicular to the longitudinal axis 216 of the RF component is discussed below in relation to FIG. 6.

Figure 15:
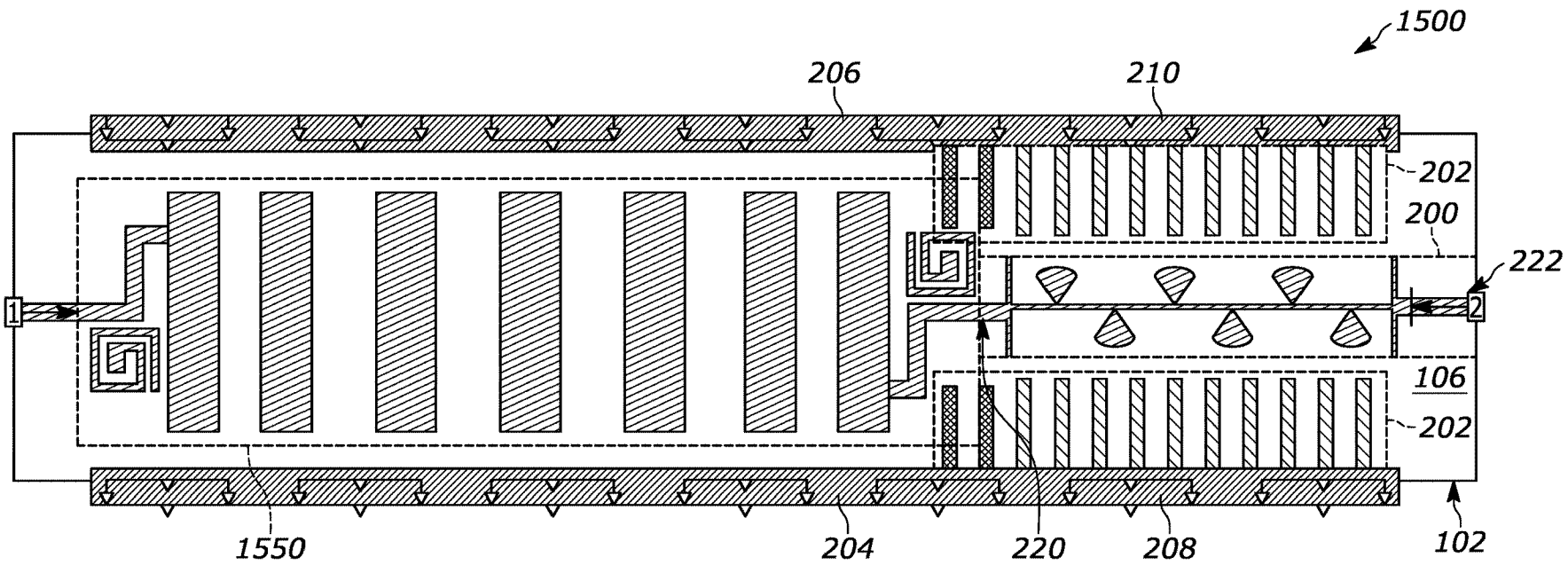
FIG. 15 shows a top view of a substrate of a RF device including a band pass filter and a low pass filter having a coplanar DGS.

The plurality of laterally extending members 212 are positioned adjacent to a portion of the RF component 200 between an input terminal and an output terminal of the RF component 200. For example, the RF component 200 includes an input terminal 220 positioned on one end of the RF component 200 and an output terminal 222 positioned on an opposite end of the RF component 200 along the longitudinal axis of the RF component 200. The input terminal 220 and the output terminal 222 can be connected to one or more RF components formed on the substrate 102 or formed on a different substrate. The RF component 200 includes a portion 224 that is positioned between the input terminal 220 and the output terminal 222. The DGS 202 is positioned adjacent to the portion 224 of the RF component 200. In some embodiment, the DGS 202 does not extend beyond the input terminal 220 and the output terminal 222 along the longitudinal axis 216 of the RF component 200. However, in some other embodiments, a portion of the DGS 202 may extend beyond the input terminal 220 or the output terminal 222 along the longitudinal axis 216 of the RF component 200 (for example, as shown in FIG. 15). The DGS 202 can be spaced apart from the RF component 200. For example, the DGS 202 can be separated from the RF component 200 by a distance D on either side of the RF component 200. In some embodiments, the value of D can be between 5 mils and 100 mils. In some embodiments, the distance of separation of the DGS 202 on one side of the RF component 200 can be equal to the distance of separation of the DGS 202 on the other side of the RF component 200. However, in some other embodiments, such as where the DGS is asymmetrical about the longitudinal axis 216 of the RF component 200, these distances of separation can be unequal.

The DGS 202 is electrically connected to the first conductive area 204 and the second conductive area 206, which extend on the first surface 106 of the substrate 102 in a direction that is parallel to the longitudinal axis 216 of the RF component 200. For example, the laterally extending member 212A is electrically connected to an edge 226 of the first conductive area 204. Similarly, the second laterally extending member 212C is electrically connected to an edge 228 of the second conductive area 206. As mentioned above, the first and second conductive areas 204 and 206 are electrically connected to the conductive cover 104, which covers the RF component 200, and are electrically connected to the ground plane on the second surface of the substrate 102. In some instances, where the first and the second conductive areas 204 and 206 are not formed, the laterally extending members 212 may be electrically connected to the first set of vias 208 and the second set of vias 210, or can extend to the edges of the first surface 106 where they are electrically connected to the conductive coating on the side surfaces 108 of the substrate 102. In this manner, the DGS 202 and the cover 104 are electrically connected to the ground plane.

A laterally extending member 212 can have a length Lm measured along the longitudinal axis 218 of the laterally extending member 212, and a width Wm measured in a direction perpendicular to the direction of the longitudinal axis 218 of the laterally extending member 212. In some embodiments, the length Lm can have values between 10 mils and 1200 mils, and width Wm can have values between 2 mils and 48 mils. In some embodiments, the values of Lm and Wm can be expressed in electrical length, i.e., in terms of a function of a wavelength and permittivity of the material used to form the substrate 102. In some embodiments, the 50 ohm laterally extending member 212 at an example frequency of 20 GHz and permittivity values of the substrate in the range of 2 to 200 can have a length Lm with values in the range of 10 mils to 200 mils. In some embodiments, the 50 ohm laterally extending member 212 at an example frequency of 2 GHz and permittivity values of the substrate in the range of 2 to 200 can have a length Lm with values in the range of 100 mils to 1500 mils. In the example shown in FIG. 2, the lengths Lm of all laterally extending members 212 are equal, and the widths Wm of all laterally extending members 212 are equal. However, the laterally extending members 212 can have non-uniform lengths Lm or non-uniform widths Wm. In some embodiments, the DGS 202 can be symmetrical about the longitudinal axis 216 of the RF component 200. That is, the number of laterally extending members 212 on one side of the RF component 200 is equal to the laterally extending members 212 on the other side of the RF component 200. Further, the dimensions (length Lm and width Wm) of a laterally extending member 212 on one side of the RF component 200 are the same as the corresponding dimensions of the corresponding laterally extending member 212 on the other side of the RF component 200. In some instances, the DGS 202 can be asymmetrical about the longitudinal axis 216 of the RF component 200. That is, at least one aspect of: a number of laterally extending members 212, a length of an laterally extending member 212, a width of an laterally extending member 212, a gap between adjacent laterally extending members 212, or a distance of separation between an laterally extending member 212 and the RF component 200 on one side of the RF component 200 can be different from the corresponding aspect on the other side of the RF component 200.

Figure 3:
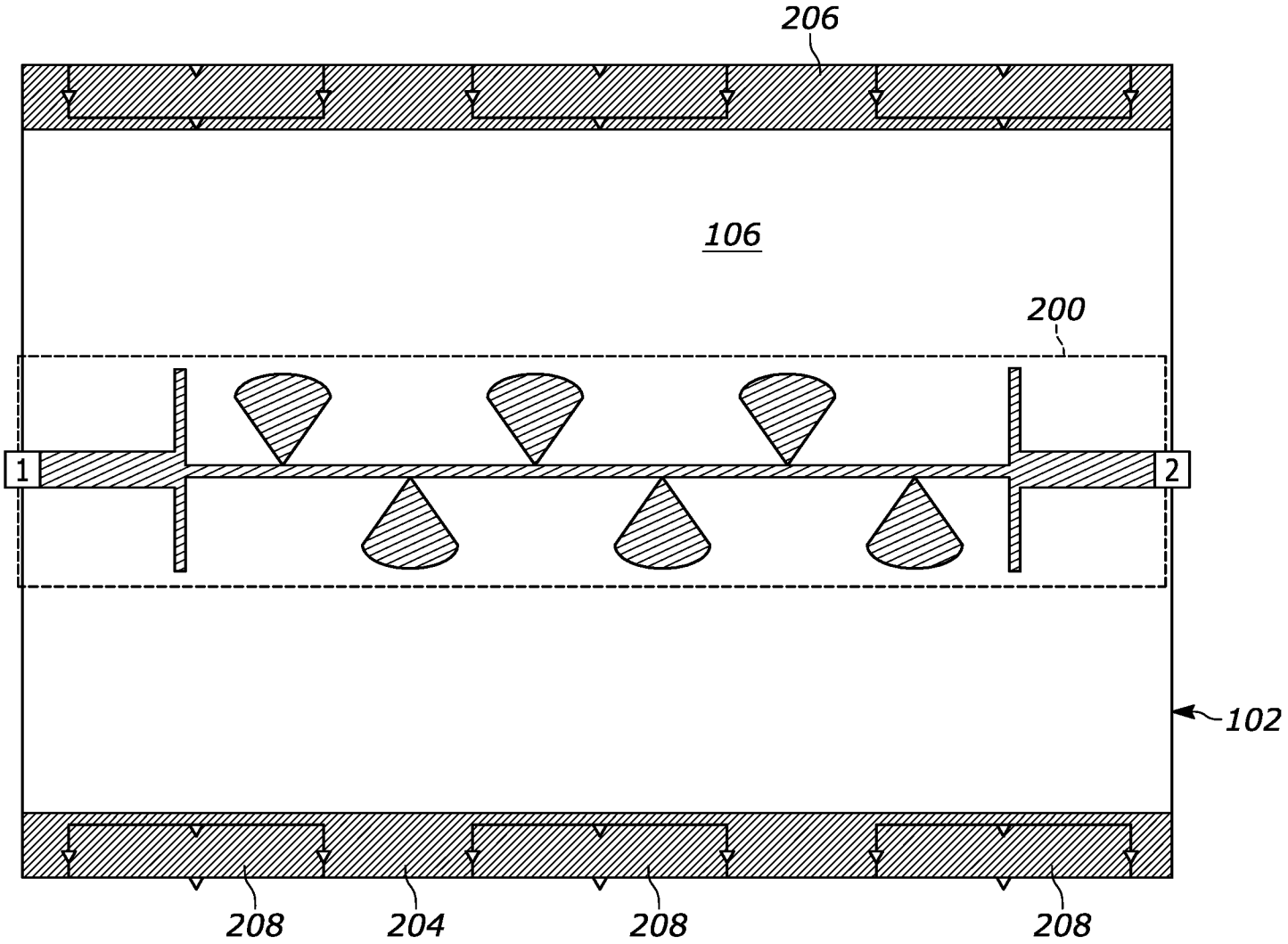
FIGS. 3 and 4 show the RF component shown in FIG. 2 without a coplanar DGS and the corresponding frequency response curves.
Figure 4:
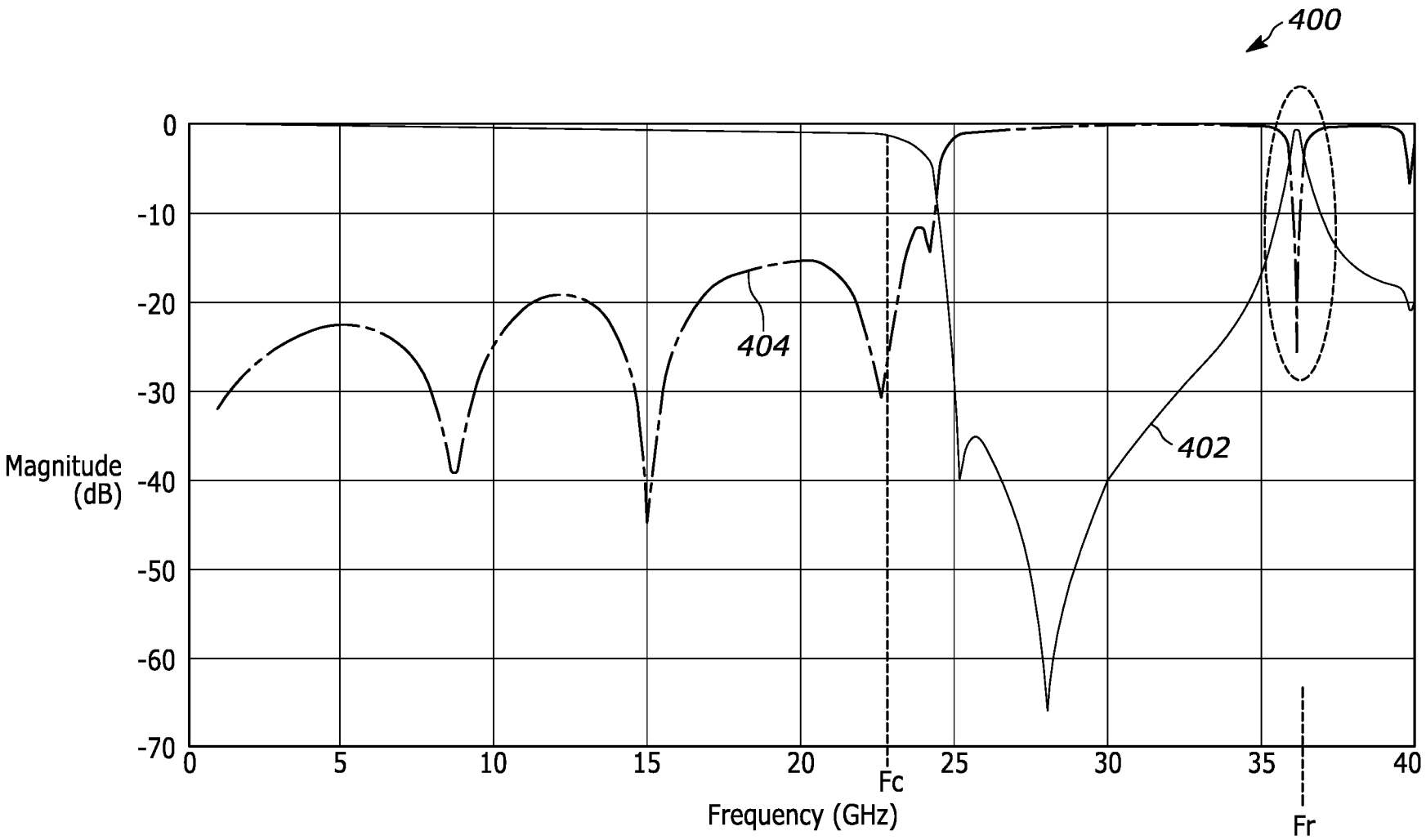

As mentioned above, the dimensions of the laterally extending members 212 can be selected based on a desired resonant frequency of the DGS 202. The resonant frequency of the DGS 202, in turn, can be selected based in part on the frequencies identified to be suppressed. FIGS. 3 and 4 show the RF component 200 shown in FIG. 2 without the DGS 202 and the corresponding frequency response curves 400. The RF component 200 shown in FIG. 3 is a low-pass filter, and FIG. 4 shows an insertion loss curve 402 and a return loss curve 404 corresponding to the simulation of the RF component 200 shown in FIG. 4. The cut-off frequency of the RF component 200 is indicated by "Fc". The RF component 200 exhibits harmonics and spurious modes at frequencies higher than the cut-off frequency Fc. For example, "Fr" indicates the frequency at which harmonics and spurious modes manifest in the response characteristics of the RF component 200. In the example shown in FIG. 4, Fc is approximately 23 GHz, and Fr is approximately 36 GHz. The DGS 202 can be designed to suppress or move to higher frequencies the harmonics and spurious modes exhibited by the RF component 200. For example, the dimensions of the laterally extending members 212 can be selected such that the resulting resonant frequency of the DGS 202 corresponds to the frequency Fr. As an example, referring to the DGS 202 shown in FIG. 2, the length Lm of the laterally extending member 212 can be selected to be equal to $\lambda/4$ or $2\lambda/3$, where $\lambda$ is the wavelength corresponding to the frequency Fr.

Figure 5:
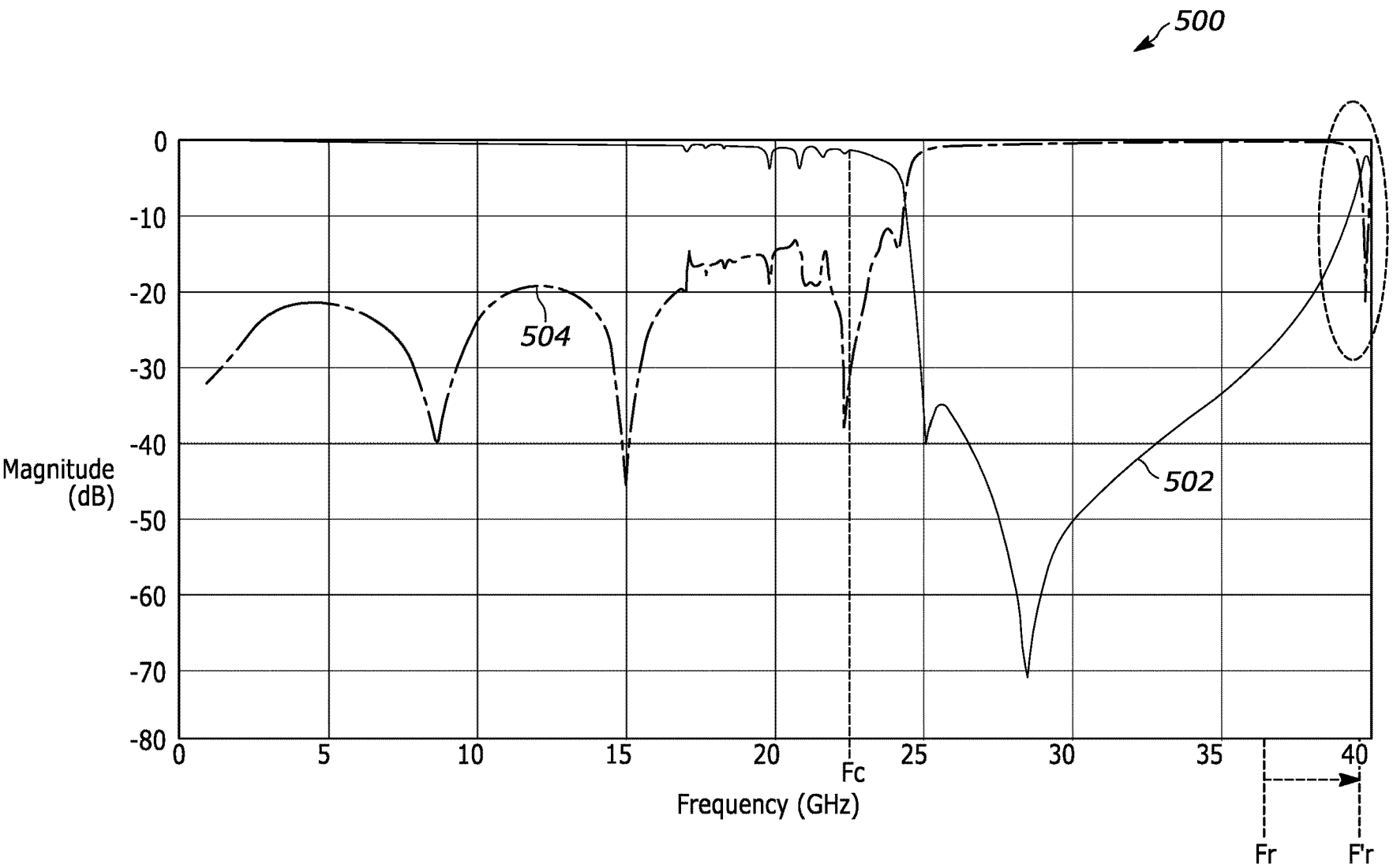
FIG. 5 shows frequency response curves for the RF component when used in combination with the coplanar DGS shown in FIG. 2.

FIG. 5 shows frequency response curves 500 for the RF component 200 when used in combination with the coplanar DGS 202 shown in FIG. 2. In particular, the frequency response curves 500 include the insertion loss curve 502 and the return loss curve 504. The frequency response curves 500 have been generated based on a cover, such as the cover 104 shown in FIG. 1, positioned over the first surface 106 of the substrate 102. As shown in FIG. 5, the inclusion of the coplanar DGS 202 results in a favorable change in the response curves of the RF component 200. In particular, the harmonics and spurious modes that appeared at frequency Fr, are instead pushed to a higher frequency F'r. For example, the DGS 202 causes the harmonics and spurious modes to appear at a relatively higher frequency of approximately 40 GHz. The DGS 202 can provide a ground that has resonant characteristics, the resonance frequency of which can be selected to align with the frequency at which the harmonics and spurious modes appear. The resulting overall frequency response of the RF component 200 utilizing the coplanar DGS 202 suppresses or pushes the harmonics and spurious modes to higher frequencies. In the example shown in FIG. 5, the harmonics and spurious modes are pushed to a frequency F'r, which is at about 40 GHz. The resonant frequency of the DGS 202 can be set between a range of 1 GHz to 300 GHz.

Figure 6:
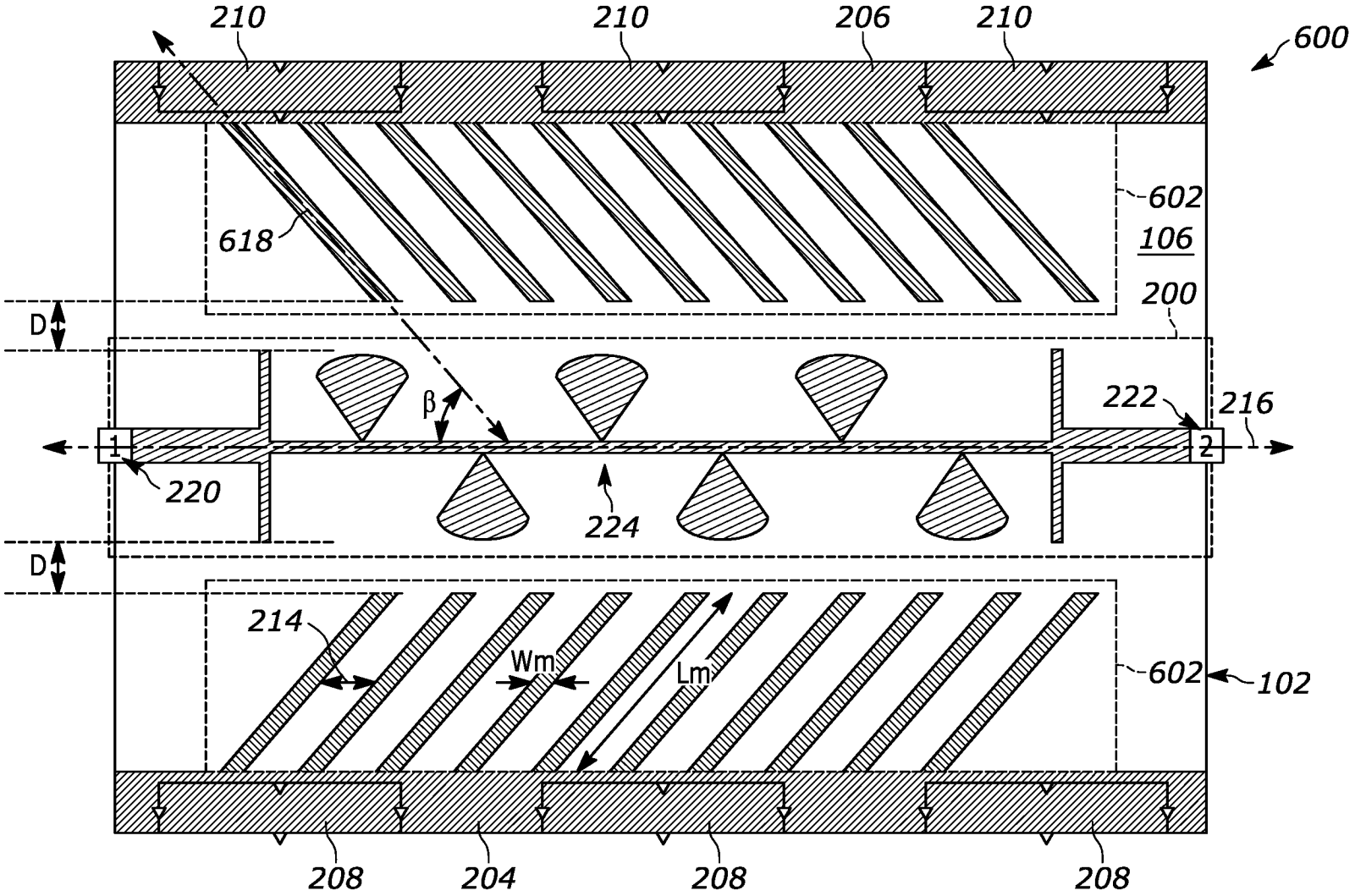
FIG. 6 shows a top view of a substrate of an RF device including a second example coplanar DGS.

FIG. 6 shows a top view of a substrate of an RF device 600 including a second example coplanar DGS 602. The RF component 200 shown in FIG. 6 is the same RF component discussed above in relation to FIG. 2. The RF device 600 further includes a second example DGS 602 that is coplanar with the RF component 200. The second example DGS 602 is similar in many respects to the first example DGS 202 discussed above in relation to FIGS. 2-6. However, unlike the laterally extending members 212 of the first example DGS 202, whose longitudinal axes 218 are perpendicular to the longitudinal axis 216 of the RF component, the laterally extending members 612 of the second example DGS 602 have longitudinal axes 618 that form a non-perpendicular angle $\beta$ with the longitudinal axis 216 of the RF component 200. In some embodiments, the angle $\beta$ can have a value between 10 degrees and 89 degrees. By placing the laterally extending members 612 at an angle that is not perpendicular with respect to the longitudinal axis 216 of the RF component 200 allows the laterally extending members 612 to be longer with respect to the length Lm of the laterally extending members 212 shown in FIG. 2. The length Lm of the laterally extending members 612 can be determined based on the desired resonant frequency. If the space between the RF component 200 and the first and second conductive areas 204 and 206 is inadequate to accommodate the laterally extending members 612 in an orientation that is perpendicular to the longitudinal axis 216 of the RF component 200, then the laterally extending members 612 can be oriented in with an appropriate angle $\beta$. This can be particularly beneficial in instances where the overall width of the substrate 102 cannot be changed due to packaging restrictions. In some embodiments, at least a portion of the DGS 602 may extend beyond the input terminal 220 or the output terminal 222 along the longitudinal axis 216 of the RF component 200. Aspects such as symmetry of the DGS 602, width of laterally extending members 612, and spacing of the laterally extending members 612, can be similar to the respective aspects of the DGS 202 discussed above in relation to FIGS. 2-5.

Figure 7:
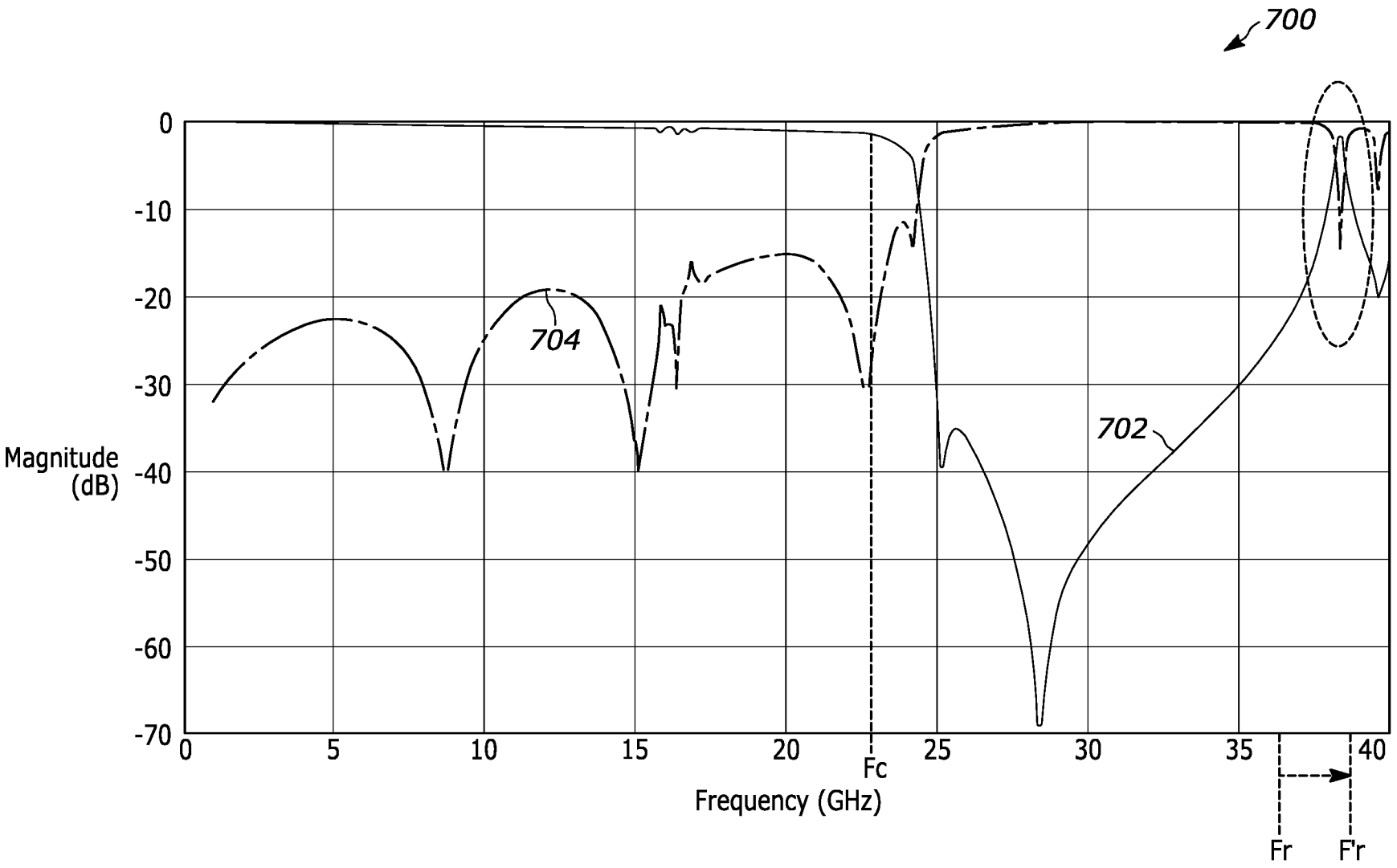
FIG. 7 shows frequency response curves for the RF component when used in combination with the coplanar second example DGS shown in FIG. 6.

FIG. 7 shows frequency response curves 700 for the RF component 200 when used in combination with the coplanar second example DGS 602 shown in FIG. 6. In particular, the frequency response curves 700 include the insertion loss curve 702 and the return loss curve 704. The frequency response curves 700 have been generated based on a cover, such as the cover 104 shown in FIG. 1, positioned over the first surface 106 of the substrate 102. As shown in FIG. 7, the inclusion of the coplanar second example DGS 602 results in a favorable change in the response curves of the RF component 200. In particular, the harmonics and spurious modes that appeared at frequency Fr, are instead pushed to a higher frequency F'r. For example, the second example DGS 602 causes the harmonics and spurious modes to appear at a relatively higher frequency of approximately 38 GHz.

Figure 8:
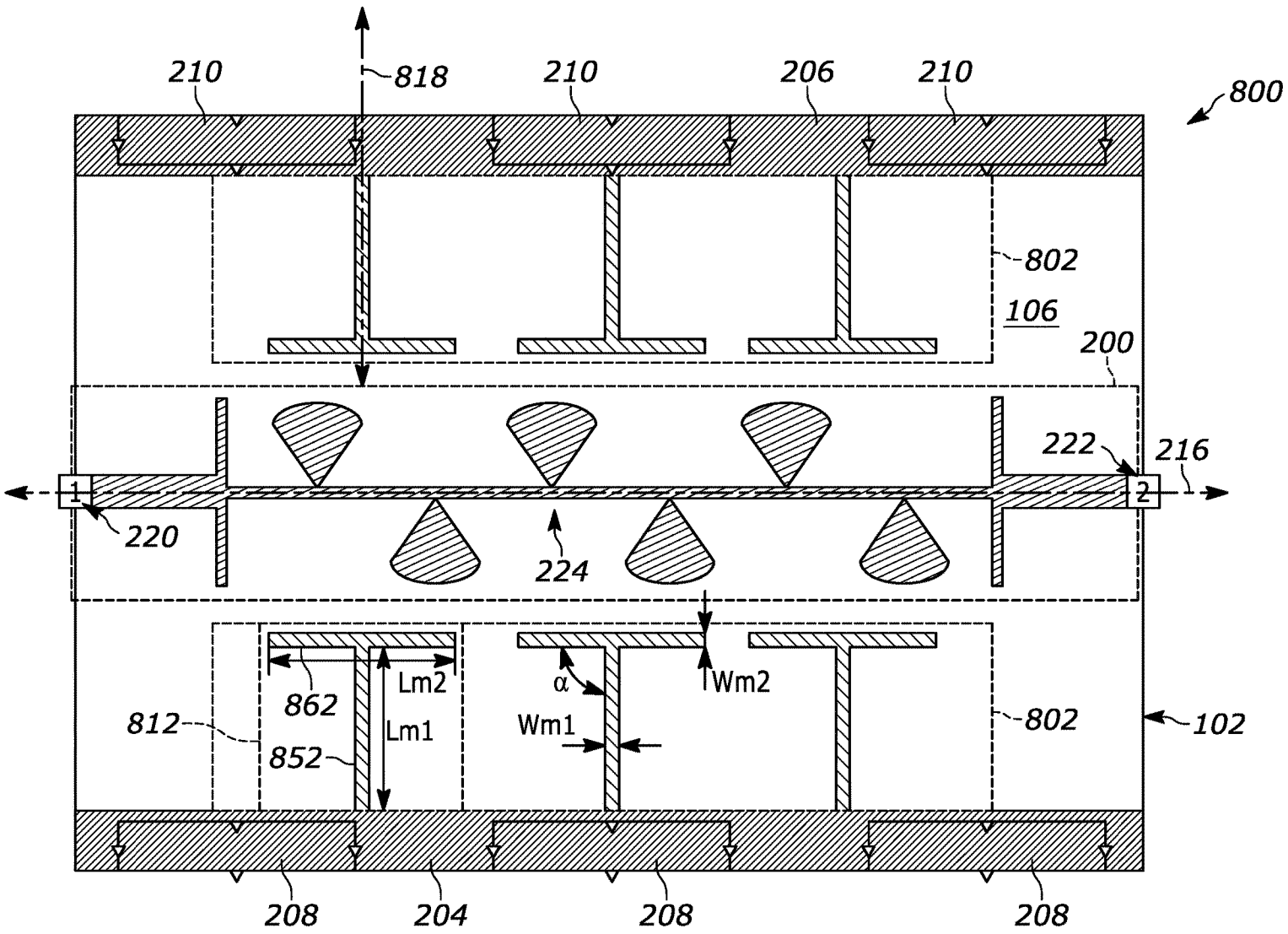
FIG. 8 shows a top view of a substrate of an RF device including a third example coplanar DGS.

FIG. 8 shows a top view of a substrate of an RF device 800 including a third example coplanar DGS 802. The RF component 200 shown in FIG. 8 is the same RF component discussed above in relation to FIG. 2. The RF device 800 further includes the third example DGS 802 that is coplanar with the RF component 200. The third example DGS 802 is similar in many respects to the first example DGS 202 discussed above in relation to FIGS. 2-6. However, unlike the laterally extending members 212 of the first example DGS 202, which have a linear shape, the laterally extending members 812 of the third example DGS 802 have a non-linear shape. In particular, the laterally extending members 812 of the third example DGS 802 are 'T' shaped. The third example DGS 802 includes three 'T' shaped laterally extending members 812 on each of the two sides of the longitudinal axis 216 of the RF component 200. However, in some other embodiments, the number of laterally extending members 812 can be different from that shown in FIG. 8. Each laterally extending member 812 can include a first segment 852 and a second segment 862. The first segment 852 extends between the first conductive area 204 and the second segment 862. A portion between the ends of the second segment 862 is connected to the first segment 852. A longitudinal axis of the first segment 852 can form an angle $\alpha$ with a longitudinal axis of the second segment 862. In the embodiment shown in FIG. 8, the angle $\alpha$ is equal to 90 degrees. However, in some embodiments, the angle $\alpha$ can be an acute or an obtuse angle. The longitudinal axis 818 of the first segment 852 is perpendicular to the longitudinal axis 216 of the RF component 200. In some embodiments, the longitudinal axis 818 can form a non-perpendicular angle with the longitudinal axis 216 of the RF component 200.

The length Lm1 of the first segment 852 is greater than the length Lm2 of the second segment 862. In some embodiments, the length Lm1 of the first segment 852 can be equal to, or greater than, the length Lm2 of the second segment 862. The width Wm1 of the first segment 852 is equal to the width Wm2 of the second segment 862. However, in some embodiments, the width Wm1 can be greater than or less than the width Wm2. In some embodiments, the dimensions of the first segment 852 and the second segment 862 can be determined based on the desired resonant frequency of the third example DGS 802. The 'T' shape of the laterally extending member 812 has an effective length Leff that is greater than the length Lm1 of the first segment 852. In some instances, the Leff can be a sum of the lengths Lm1 and Lm2 of the first and the second segments 852 and 862. In some other instances, the effective length Leff of the laterally extending member 812 can be a less than the sum of the lengths Lm1 and Lm2. Generally, the effective length Leff of the laterally extending member 812 is a function of the lengths Lm1 and Lm1 of the first and second segments 852 and 862, respectively. In some embodiments, the Lm1 can have values between 20 mils and 60 mils, Lm2 can have values between 20 mils and 60 mils, Wm1 can have values between 2 mils and 12 mils, and Wm2 can have values between 2 mils and 12 mils. These values can be based on a signal frequency between 2 GHz and 20 GHz and permittivity (of the substrate 102) between 2 and 200. In some embodiments, the angle $\alpha$ can have values between 60 degrees and 120 degrees. Aspects such as symmetry of the DGS 802, width of laterally extending members 812, and spacing of the laterally extending members 812 can be similar to the respective aspects of the DGS 202 discussed above in relation to FIGS. 2-5.

Figure 9:
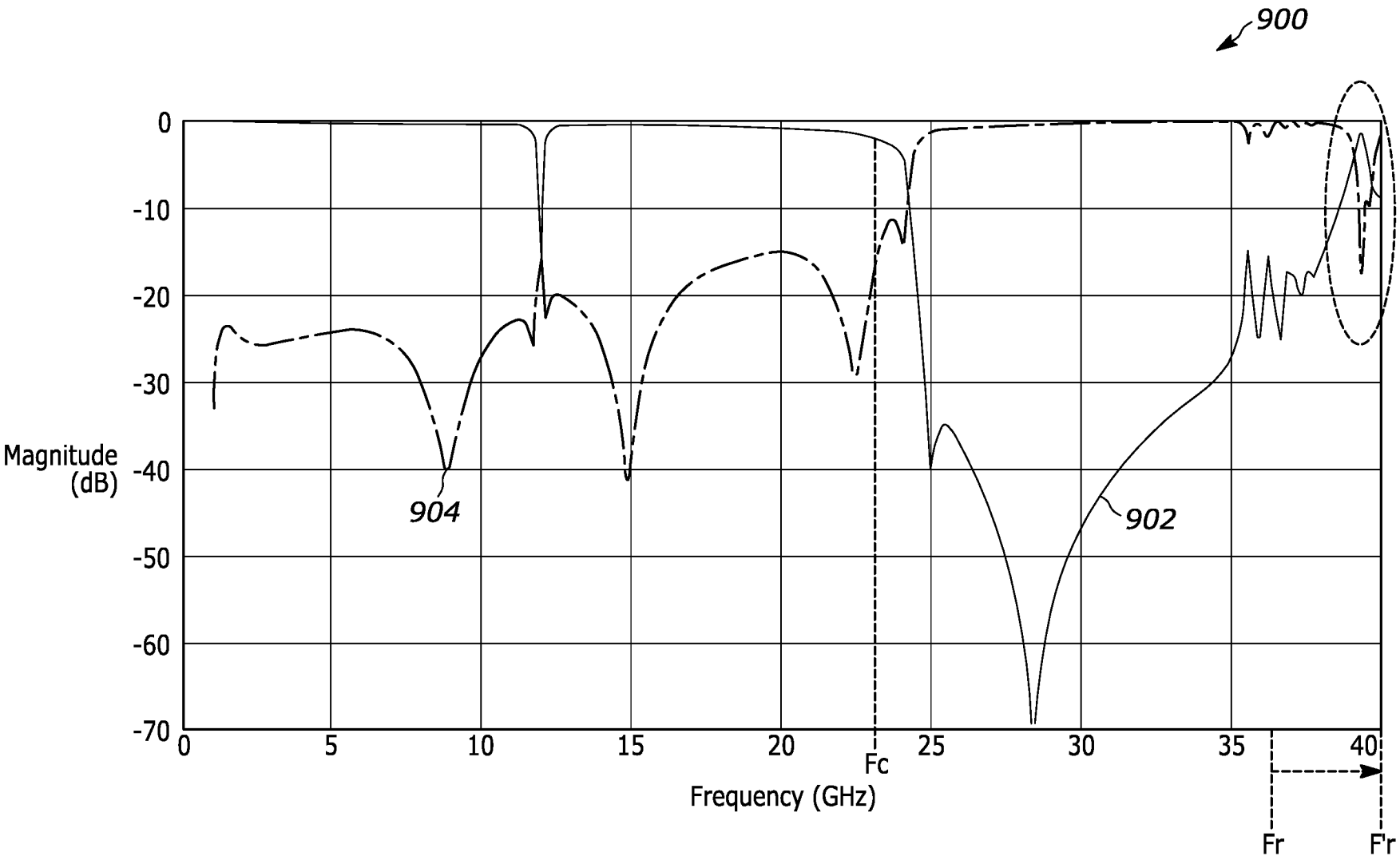
FIG. 9 shows frequency response curves for the RF component when used in combination with the coplanar third example DGS shown in FIG. 8.

FIG. 9 shows frequency response curves 900 for the RF component 200 when used in combination with the coplanar third example DGS 802 shown in FIG. 8. In particular, the frequency response curves 900 include the insertion loss curve 902 and the return loss curve 904. The frequency response curves 900 have been generated based on a cover, such as the cover 104 shown in FIG. 1, positioned over the first surface 106 of the substrate 102. As shown in FIG. 9, the inclusion of the coplanar third example DGS 802 results in a favorable change in the response curves of the RF component 200. In particular, the harmonics and spurious modes that appeared at frequency Fr, are instead pushed to a higher frequency F'r. For example, the third example DGS 602 causes the harmonics and spurious modes to appear at a relatively higher frequency of approximately 40 GHz.

Figure 10:
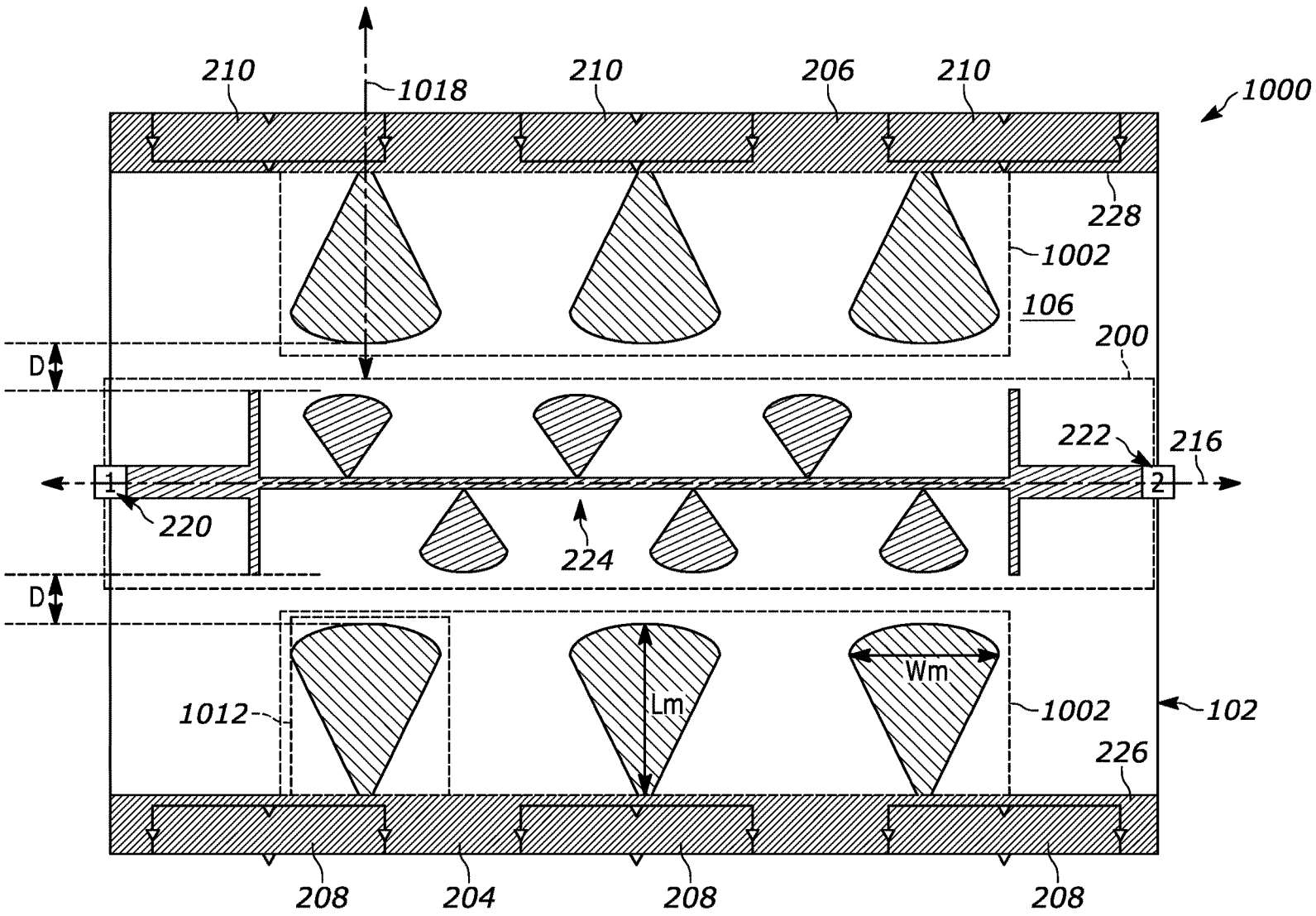
FIG. 10 shows a top view of a substrate of an RF device including a fourth example coplanar DGS.

FIG. 10 shows a top view of a substrate of an RF device 1000 including a fourth example coplanar DGS 1002. The RF component 200 shown in FIG. 10 is the same RF component discussed above in relation to FIG. 2. The RF device 1000 further includes the fourth example DGS 1002 that is coplanar with the RF component 200. The fourth example DGS 1002 is similar in many respects to the first example DGS 202 discussed above in relation to FIGS. 2-6. However, unlike the laterally extending members 212 of the first example DGS 202, which have a linear shape, the laterally extending members 1012 of the fourth example DGS 1002 have a non-linear shape. In particular, the laterally extending members 1012 of the fourth example DGS 1002 are fan-shaped. The fourth example DGS 1002 includes three fan-shaped laterally extending members 1012 on each of the two sides of the longitudinal axis 216 of the RF component 200. However, in some other embodiments, the number of laterally extending members 1012 can be different from that shown in FIG. 10. A longitudinal axis 1018 of the laterally extending members 1012 is perpendicular to the longitudinal axis 216 of the RF component 200. However, in some other embodiments, the longitudinal axis 1018 of the laterally extending members 1012 can form a non-perpendicular angle with the longitudinal axis 216 of the RF component 200. The laterally extending member 1012 can have a length Lm and a width Wm. The dimensions of the laterally extending members 1012 can be a function of the desired resonant frequency. The frequency response of the RF component 200 can be similar to the frequency response of shown in FIGS. 5, 7, and 9. That is, the fourth DGS 1002 can suppress the harmonics and the spurious mode or push them to higher frequencies. Aspects such as symmetry of the fourth DGS 1002, width of laterally extending members 1012, and spacing of the laterally extending members 1012 can be similar to the respective aspects of the DGS 202 discussed above in relation to FIGS. 2-5.

Figure 11:
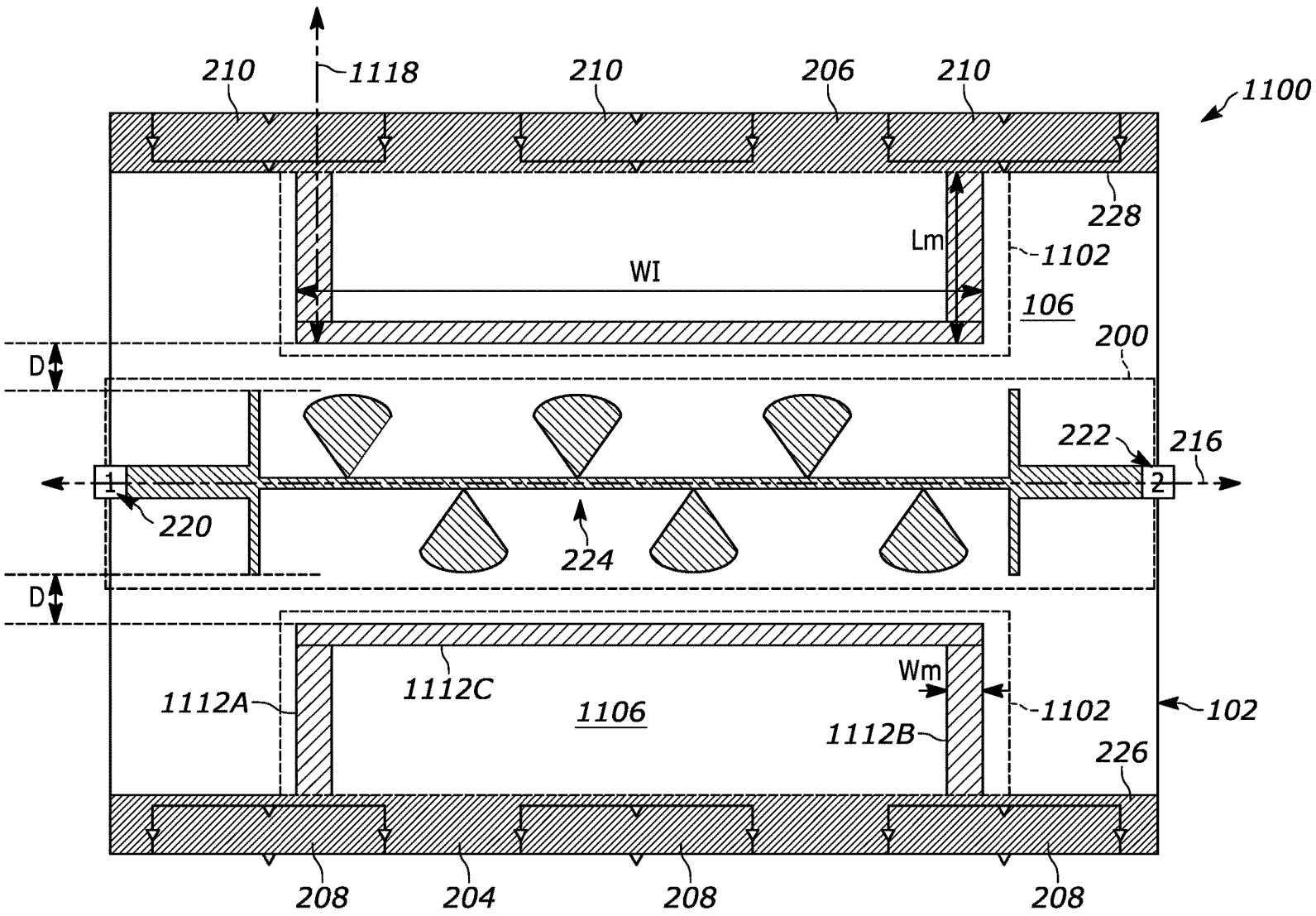
FIG. 11 shows a top view of a substrate of an RF device including a fifth example coplanar DGS.

FIG. 11 shows a top view of a substrate of an RF device 1100 including a fifth example coplanar DGS 1102. The RF component 200 shown in FIG. 11 is the same RF component discussed above in relation to FIG. 2. The RF device 1100 further includes the fifth example DGS 1102 that is coplanar with the RF component 200. The fifth example DGS 1102 has a looped shape. In particular, the fifth example DGS 1102 includes two laterally extending members 1112A and 1112B, one end of each of which is connected to the first conductive area 204. The two laterally extending members 1112A and 1112B may be interconnected to form the looped shape. For instance, the other end of each of the two laterally extending members 1112A and 1112B may be connected with an interconnecting member 1112C, which can be formed of the same material as the two laterally extending members 1112A and 1112B. The two laterally extending members 1112A and 1112B in combination with the interconnecting member 1112C and the first conductive area 204, can define a loop that extends around an exposed area 1106 of the first surface 106 of the substrate 102. A similar loop can be formed on the other side of the longitudinal axis 216 of the RF component 200. The two laterally extending members 1112A and 1112B can have a length Lm and a width Wm. The longitudinal axes 1118 of the two laterally extending members 1112A and 1112B can extend laterally relative to (e.g., be perpendicular to, or extend at an angle relative to) the longitudinal axis 216 of the RF component 200. In some other embodiments, the longitudinal axes 1118 can be at a non-perpendicular angle with the longitudinal axis 216 of the RF component 200. The overall width W1 of the looped shaped fifth DGS 1102 along with the dimensions of the laterally extending members 1112A and 1112B, and the dimensions of the interconnecting member 1112C can be a function of the desired resonant frequency of the fifth DGS 1102. In some embodiments, the width WI can have a value between 8 mils and 300 mils. The frequency response of the RF component 200 can be similar to the frequency response of shown in FIGS. 5, 7, and 9. That is, the fifth DGS 1102 can suppress the harmonics and the spurious mode or push them to higher frequencies. While FIG. 11 shows a single loop formed on each side of the longitudinal axis 216 of the RF component 200, in some embodiments, the DGS 1102 can include more than one loop on each side. In some embodiments, the length Lm can have values between 10 mils and 1200 mils, and width Wm can have values between 10 mils and 1200 mils. In some embodiments, the values of Lm and Wm can be expressed in electrical length, i.e., in terms of a function of a wavelength and permittivity of the material used to form the substrate 102. In some embodiments, the 50 ohm laterally extending member 1112 at an example frequency of 20 GHz and permittivity values of the substrate in the range of 2 to 200 can have a length Lm with values in the range of 10 mils to 200 mils. In some embodiments, the 50 ohm laterally extending member 1112 at an example frequency of 2 GHz and permittivity values of the substrate in the range of 2 to 200 can have a length Lm with values in the range of 100 mils to 1500 mils. Aspects such as symmetry of the fifth DGS 1102, width of laterally extending members 1112, and spacing of the laterally extending members 1112 can be similar to the respective aspects of the DGS 202 discussed above in relation to FIGS. 2-5.

Figure 12:
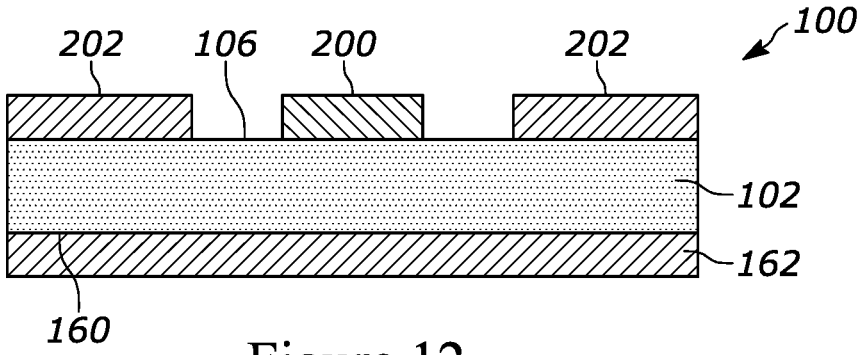
FIG. 12 shows a cross-sectional view of the RF device shown in FIG. 1.

FIG. 12 shows a cross-sectional view of the RF device 100 shown in FIG. 1. In particular, the cross-sectional view shows the substrate 102 and the RF component 200 disposed on the first surface 106 of the substrate 102. A cover is not shown for simplicity. The RF device 100 also includes a DGS 202 that is also disposed on the first surface 106 on which the RF component 200 is disposed. While DGS 202 corresponds to the DGS 202 shown in FIG. 2, any of the other DGSs discussed herein can also be disposed on the first surface 106. That is, the DGS 202 is coplanar with the RF component 200. The substrate 102 includes a second surface 160 opposite the first surface 106. A conductive layer 162 is disposed over the second surface 160 of the substrate 102, and forms a ground plane that is electrically insulated from the RF component 200 by the substrate 102. While not shown in FIG. 12, the DGS 202 is electrically connected to the conductive layer 162 by way of vias (e.g., 208 and 210, FIG. 2) or conductive coatings on the side surfaces (e.g., 108, FIG. 1).

Figure 13:
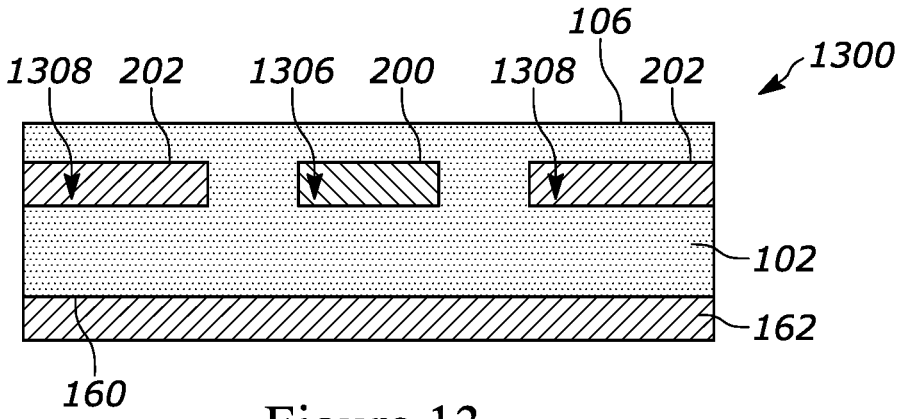
FIG. 13 shows a cross-sectional view of an RF device that includes an embedded RF component and an embedded coplanar DGS.

FIG. 13 shows a cross-sectional view of an RF device 1300 that includes embedded RF components and coplanar DGS. In particular, the RF device 1300 includes an RF component 200 that is embedded in a substrate 102. The RF component 200 is disposed on a first embedded surface 1306 of the substrate 102. The RF device 1300 also includes a DGS 202 similar to those discussed above. The DGS 202 is also embedded in the substrate 102 and is disposed on a second embedded surface 1308 of the substrate 102. Thus, both the RF component 200 and the DGS 202 are disposed within the substrate 102 between the first surface 106 and the second surface 160 of the substrate 102. Further, the first embedded surface 1306 is coplanar with the second embedded surface 1308, and separated from each other by intervening material of the substrate 102. The first embedded surface 1306 (e.g., having the RF component 2000) and the second embedded surface 1308 (e.g., having the DGS 202) may not physically extend into or overlap with each other to form a single surface. Thus, the DGS 202 can be coplanar with the RF component 200, and be electrically insulated or isolated from the RF component 200 by intervening material of the substrate 102. In some instances, the substrate 102 can be formed by combining two or more separate substrate layers. For example, a substrate layer of the same material as the substrate 102 shown in FIG. 12 can be positioned over the substrate 102 shown in FIG. 12 and cover the RF component 200 and the DGS 202. The resulting RF device would have the RF component 200 and the DGS 202 embedded between the two substrate layers similar to that shown in FIG. 13. The process for forming the RD devices shown in FIGS. 12-13 (and FIG. 14 discussed below) can vary and can in some embodiments, be based on the material utilized for forming the substrate. In some embodiments, the substrate 102 can be formed sub-layer by sub-layer (e.g., by deposition techniques), or built in separate independent layers that are bonded to each other, and where the metal layers representing the coplanar DGS and the RF component can be bonded to the respective surfaces of the substrate 102.

Figure 14:
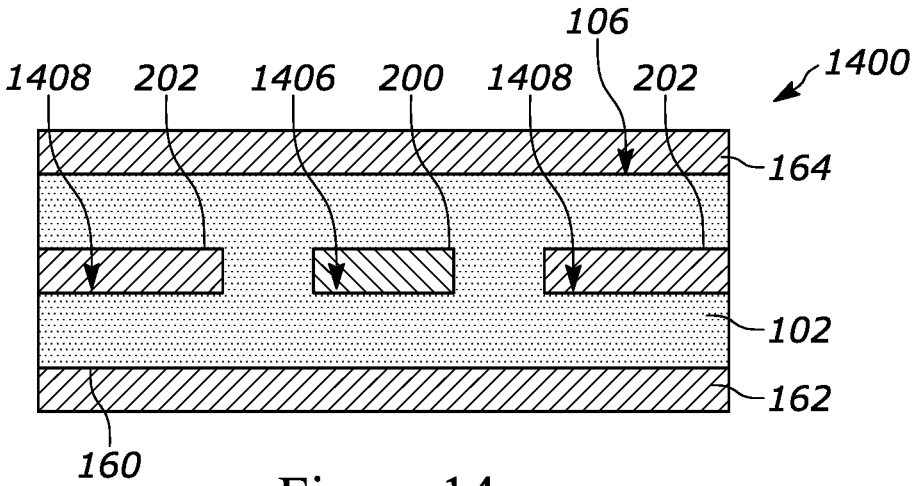
FIG. 14 shows a cross-sectional view of a strip-line RF device that includes an embedded RF component and an embedded coplanar DGS.

FIG. 14 shows a cross-sectional view of a strip line RF device 1400 that includes an embedded RF component and an embedded coplanar DGS. In particular, the strip line RF device 1400 includes a substrate 102 having a first surface 106 and an opposite second surface 160. A first conductive layer 164 is disposed on the first surface 106 and a second conductive layer 162 is disposed on the second surface 160. The first conductive layer 164 and the second conductive layer 162 form ground planes, and are electrically connected to each other. The RF component 200 and the DGS 202 are embedded in the substrate 102. The RF component 200 is disposed on a first embedded surface 1406 of the substrate 102, and is electrically insulated from both the first conductive layer 164 and the second conductive layer 162. The DGS 202 is disposed on a second embedded surface 1408, where the first embedded surface 1406 and the second embedded surface 1408 are coplanar (e.g., similar to the features discussed above in connection with FIG. 13). Thus, the DGS 202 is coplanar with the RF component 200. In some instances, the substrate 102 can be formed by combining two or more separate substrate layers. The coplanar DGS 202 can be implemented in other strip-line RF devices as well.

FIG. 15 shows an example RF device 1500 including a band pass filter 1550 and a low pass filter 200 having a coplanar DGS 202. While not shown in FIG. 14, the RF device 1500 also includes a cover, such as the cover 104 shown in FIG. 1, disposed over the substrate 102. The band pass filter 1550 is disposed over the first surface 106 of the substrate 102. The low pass filter 200 is coplanar with the DGS 202. In some embodiments, the DGS 202 can extend beyond the input terminal 220 or the output terminal 222 along the longitudinal axis 216 of the RF component 200. In some embodiments, the DGS 202 can be extended to be adjacent to the band pass filter 1550 as well. In some such embodiments, the size of the substrate 102 can be selected to accommodate a DGS on one or both sides of a longitudinal axis of the band pass filter 1550. The resonant frequency of the DGS can be selected to be greater than both a center frequency of the band pass filter 1550 and the cut off frequency of the low pass filter 200.

Figure 16:
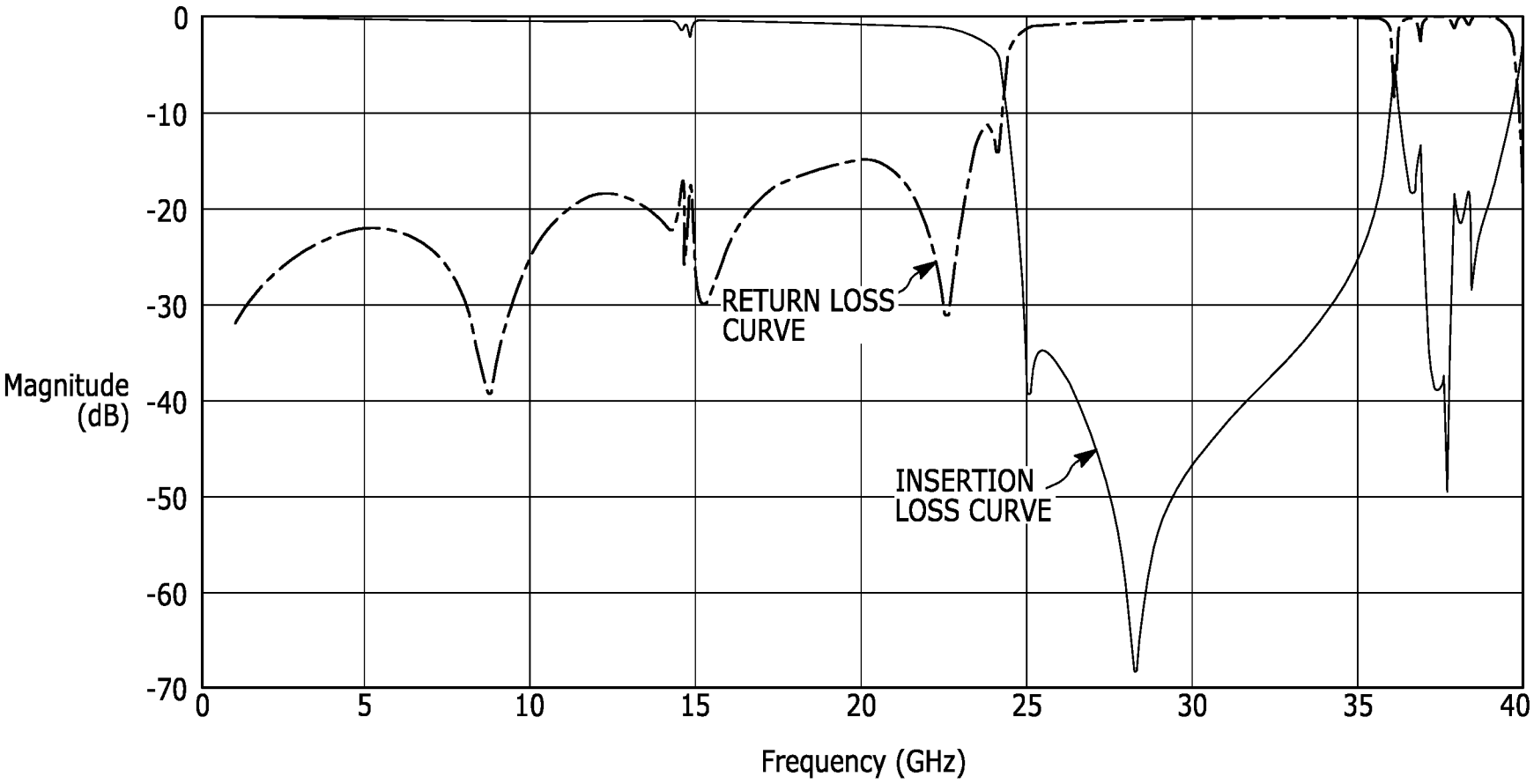
FIG. 16 shows frequency response curves for the RF component when used in combination with the coplanar fourth example DGS shown in FIG. 10.

FIG. 16 shows frequency response curves for the RF component 200 when used in combination with the coplanar fourth example DGS 1002 shown in FIG. 10. The harmonics and spurious modes are suppressed or pushed to a higher frequency.

Figure 17:
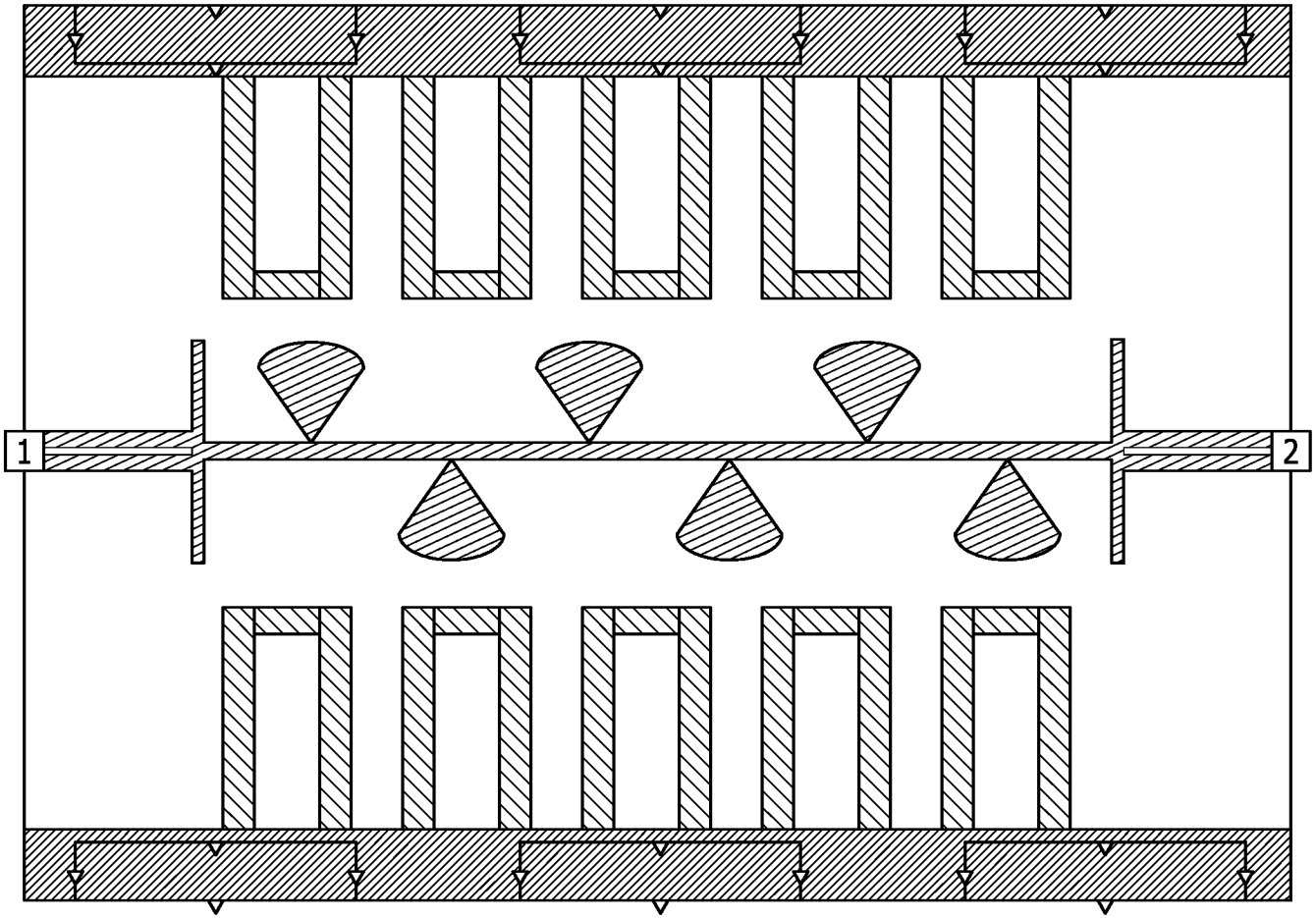
FIG. 17 shows a top view of a substrate of an RF device including a variation of the fifth example coplanar DGS 1102 shown in FIG. 11.

FIG. 17 shows a top view of a substrate of an RF device including a variation of the fifth example coplanar DGS 1102 shown in FIG. 11. In particular, the DGS includes more than one loop on each side of a longitudinal axis of the RF component.

The herein described subject matter sometimes illustrates different components contained within, or connected with, different other components. It is to be understood that such depicted architectures are illustrative, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B." Further, unless otherwise noted, the use of the words "approximate," "about," "around," "substantially," etc., mean plus or minus ten percent.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A radio frequency (RF) device comprising:

a substrate comprising a dielectric material;

an RF component disposed over a first surface of the substrate, the RF component comprising a low pass filter cascaded with a band-pass filter;

a ground plane disposed over a second surface, opposite the first surface, of the substrate and electrically insulated from the RF component;

a defected ground structure disposed over the first surface of the substrate and electrically connected to the ground plane, the defected ground structure comprising a plurality of lateral members extending toward and spaced apart from the RF component, a resonant frequency of the defected ground structure greater than a cut-off frequency of the RF component, wherein the defected ground structure rejects frequencies outside the passband of the RF component.

2. The RF device of claim 1, wherein a resonant frequency of the defected ground structure is a function of a length of the plurality of lateral members measured in a dimension non-parallel to a longitudinal axis of the RF component.

3. The RF device of claim 2, wherein the RF component includes an input terminal and an output terminal, wherein the plurality of lateral members are positioned adjacent the RF component between the input terminal and the output terminal.

4. The RF device of claim 3, further comprising a conductive cover disposed over the first surface of the substrate, the conductive cover electrically coupled with the defected ground structure, wherein the conductive cover covers the RF component.

5. The RF device of claim 4, wherein the defected ground structure includes a conductive region extending in a direction parallel to a longitudinal axis of the RF component, wherein the conductive region is electrically coupled with the conductive cover.

6. The RF device of claim 4, wherein the defected ground structure includes vias electrically coupled to the conductive cover.

7. The RF device of claim 2, wherein the resonant frequency of the defected ground structure has a value in a range of 1 GHz to 300 GHz.

8. The RF device of claim 1, wherein the plurality of lateral members includes a first plurality of lateral members extending from a first conductor disposed along a first side of the RF component and a second plurality of lateral members extending from a second conductor disposed along a second side, opposite to the first side, of the RF component.

9. The RF device of claim 8, wherein the plurality of lateral members have a non-linear shape, or a fan shape, or a T-shape, or extend around an exposed area of the first surface of the substrate.

10. A radio frequency (RF) device comprising:

a substrate having a first surface and second surface parallel to the first surface, the substrate including an electrically insulating material;

a RF component configured as a filter disposed over the first surface of the substrate;

a conductive layer disposed over the second surface of the substrate, the conductive layer forming a ground plane electrically insulated from the RF component; and a defected ground structure disposed over the first surface of the substrate and electrically connected to the conductive layer, the defected ground structure located alongside the RF component and including a plurality of laterally extending members directed toward and spaced apart from the RF component, wherein a resonant frequency of the defected ground structure is greater than a cut-off frequency of the RF component, wherein the defected ground structure rej ects frequencies outside a passband of the RF component.

11. The RF device of claim 10, wherein the defected ground structure includes gap between adjacent laterally extending members, wherein a resonant frequency of the defected ground structure is based on a dimension of the plurality of laterally extending members.

12. The RF device of claim 11, wherein the plurality of laterally extending members includes a first plurality of laterally extending members extending from a first conductor disposed along a first side of the RF component and a second plurality of laterally extending members extending from a second conductor disposed along a second side, opposite the first side, of the RF component.

13. The RF device of claim 12, wherein the defected ground structure is symmetric about a longitudinal axis of the RF component.

14. The RF device of claim 11, wherein each of the plurality of laterally extending members has a longitudinal axis that is perpendicular to a longitudinal axis of the RF component.

15. The RF device of claim 11, wherein each of the plurality of laterally extending members has a longitudinal axis that is non-parallel to a longitudinal axis of the RF component.

16. The RF device of claim 11, wherein the plurality of laterally extending members are unevenly spaced.

17. The RF device of claim 11, wherein at least one of the plurality of laterally extending members has a non-linear shape, or a fan shape, or a T-shape, or a non-uniform width, or at least one loop comprising at least two adjacent laterally extending members.

18. The RF device of claim 10, wherein the filter is a low pass filter or a band pass filter.

19. The RF device of claim 10 further comprising a conductive cover disposed over the RF component and the defected ground structure, the conductive cover electrically coupled to the ground plane.

* * * * *